US005445436A

United States Patent [19]

Kemnitz

[11] Patent Number: 5,445,436

[45] Date of Patent: Aug. 29, 1995

[54] BACKING OR SEATING FOR SEATING TYPE FURNITURE AND MEANS FOR SECURING BACKING OR SEATING TO A FRAME

[75] Inventor: Glen D. Kemnitz, Gallatin, Tenn.

[73] Assignee: Sunbeam Corporation, Fort Lauderdale, Fla.

[21] Appl. No.: 962,495

[22] Filed: Oct. 15, 1992

[51] Int. Cl.[6] ..... A47C 7/02

[52] U.S. Cl. ..... 297/452.63; 297/452.64; 160/398; 160/404

[58] Field of Search ..... 297/452.63, 452.64; 160/327, 392, 395, 398, 404

[56] References Cited

U.S. PATENT DOCUMENTS

| | | | |
|---|---|---|---|
| 2,622,663 | 12/1952 | Burd | 155/187 |
| 2,667,916 | 2/1954 | Burd | 297/452.63 |
| 2,856,990 | 10/1958 | Thomas | 297/452.64 |
| 2,878,861 | 3/1959 | Molla | 297/452.63 X |
| 2,957,219 | 10/1960 | Van Buren, Jr. | 24/73 |
| 2,978,775 | 4/1961 | Kramer | 24/265 |
| 3,021,176 | 2/1962 | Eads et al. | 297/452.63 |
| 3,114,578 | 12/1963 | Hamilton | 297/452.63 |
| 3,117,775 | 1/1964 | Hamilton et al. | 297/452.63 X |
| 3,147,998 | 9/1964 | Hamilton | 297/452.63 X |
| 3,186,712 | 6/1965 | Kessler | 160/398 X |
| 3,231,008 | 1/1966 | Seckel | 297/452.63 X |
| 3,298,426 | 1/1967 | Kramer | 160/404 |
| 3,363,667 | 1/1968 | Thomas et al. | 297/452.63 X |
| 3,427,693 | 2/1969 | Adams | 297/452.63 X |
| 3,464,479 | 9/1969 | Baker | 297/452.63 X |
| 3,512,834 | 5/1970 | Lockshin | 297/441 |
| 3,584,675 | 6/1971 | Borichevsky | 297/452.63 X |
| 3,667,532 | 6/1972 | Kurz | 297/452.63 X |
| 3,724,402 | 4/1973 | Thyberg et al. | 297/452.63 |
| 3,767,261 | 10/1973 | Rowland | 297/452.63 |
| 3,910,339 | 10/1975 | Kramer . | |
| 4,339,488 | 7/1982 | Brokmann . | |
| 4,438,800 | 3/1984 | Hemmerle et al. | 297/452.63 X |
| 4,541,150 | 9/1985 | Brokmann | 160/404 X |
| 4,750,784 | 6/1988 | Schwartz | 297/452.64 |
| 4,967,424 | 11/1990 | Stegmeier | 160/395 X |
| 5,058,340 | 10/1991 | Muller | 160/395 X |

*Primary Examiner*—Alexander Grosz
*Assistant Examiner*—Suzanne L. Dino
*Attorney, Agent, or Firm*—Michael J. Kline; Darren E. Wolf; Carol I. Bordas

[57] ABSTRACT

Patio furniture, for indoor or outdoor use, is formed by frame members made of aluminum tubular extrusions or similar materials. A plurality of straps or a one piece panel with several straps forms a seat and a back for the furniture. Each end of the strap is self-locked into a slot in the frame members. The locking element is either a shear formed tab which slides into the slot of the frame members and which is an integral part of the tang of each strap, or the locking element is an external fastener, such as a canoe clip, a screw, or a Christmas tree clip which is inserted through the end of the strap and into circular holes in the frame members.

25 Claims, 5 Drawing Sheets

BACKING OR SEATING FOR SEATING TYPE FURNITURE AND MEANS FOR SECURING BACKING OR SEATING TO A FRAME

BACKGROUND OF THE INVENTION

1. Field of the Invention

The present invention relates to seating type furniture for indoor or outdoor use. More particularly, it relates to straps and/or panels for forming a seating and/or a backing for the furniture, and to means for securing the straps and/or panels to or in the frame of the furniture.

2. Description of the Prior Art

Garden, patio, or porch furniture, such as chairs, chaise lounges, gliders, or sofa-type furniture are formed by frame members which may be tubing made of aluminum or steel. The ends of the straps are retained in operative position by securing the ends to or in slots in the aluminum frame member. Generally, the straps are flexible webbing material which are interwoven, and a variety of fastening means are known for securing the straps to the frame members.

Some examples of fastening means for securing the ends of the straps to the frame members are disclosed in U.S. Pat. Nos. 2,622,663; 2,957,219; 2,978,775; 3,298,426; 3,512,834; 3,910,339; and 4,339,488. In each of these prior art references, a secondary element is affixed to the end of the strap for its securement in the frame members upon its insertion into slots in the frame members. Other forms of the prior art have separate fastener means.

In spite of the prior art, the connection between the straps or webbing material and the frame still creates a weak point with the result of detachment or the tearing off of the strap or web from the supporting frame members.

Additionally the straps or webbings for forming the backing and/or seating portion of the furniture are individual pieces which are arranged in an individual fashion or are interlaced in a woven fashion, and are made of tenuous materials which wear and erode, and eventually tear away from the supporting frame members.

There remains, therefore, a very real and substantial need for an improved backing and/or seating portion for a frame structure for a seating type piece of furniture, and an improved connection between the straps or webbings and the frame structure.

SUMMARY OF THE INVENTION

The present invention has met the above-described needs. The present invention provides a backing or a seating which is formed by either individual straps or by a one-piece integrally formed panel which is secured to a frame structure. The panel has straps or strips. Both the straps of the panel and the individual straps have a tang portion at its ends which have tabs which are integrally formed thereon and which tabs are self-locking in the slots of the frame members. Optionally, the tang portions can have apertures which are secured to the frame members by external, separate fastening means, such as a canoe clip, a screw, or a Christmas tree clip.

The tabs may be integrally molded or may be shear formed after the molding process. The tabs project away from the top or bottom longitudinal surface of the tang portion. The shear formed tab is formed such that it inclines upwardly and outwardly relative to a longitudinal edge of the tang portion. The tab is flexible enough that it is able to be pushed inwardly toward the top or bottom surface of the tang portion, when the tang portion is inserted into a slotted opening in the frame member. Once inserted, the tab springs back to its original form and abuts against the inside wall of the frame member in a locking fashion. The panel and individual straps are flexible so that the straps can be pulled and stretched to fit around and into the slotted openings of the frame members. A type of material for the panel or individual straps may be polyvinyl chloride.

Accordingly, it is an object of the invention to provide a seating element or means which can be used either as a seating or a backing of a piece of seating type of furniture.

It is a further object of the present invention to provide a seating and/or a backing for a frame of a piece of seating type furniture which is a one-piece integral panel construction, which provides more substantial support for cushion devices or which could be used as the primary seat in seating type of furniture.

It is a further object of the present invention to provide a plurality of spaced,apart straps which are secured to the frame of the furniture and which form a seating or a backing for the furniture.

It is a further object of the invention to provide a plurality of spaced-apart straps which form a seating and/or a backing on a frame, which straps have integrally formed means on its ends which self-lock when inserted into a slot in the frame.

It is a still further object of the present invention to provide a one-piece integrally molded panel for forming a seating and/or a backing on a frame having spaced apart but interconnected strap or strip elements and which elements have integrally formed means on its ends and which self-lock when inserted into a slot in the frame.

A further object of the present invention is to provide a seating and/or backing on a frame which is formed by a one-piece molded plastic panel which is flexible and which has end portions which, in turn, have tabs which are integrally formed or are sheared formed in the molding process and which tabs self lock inside the frame.

A still further object of the invention is to provide a piece of seating type furniture which has a one-piece panel which has spaced apart strap or strip elements which are either self-locking in a slot in the frame of the furniture or are attached to the frame by external fastening means.

A still further object of the present invention is to provide an improved connection between the straps or strips and the frame of a seating type piece of furniture.

A further object of the present invention is to provide an improved connection between straps individually arranged or straps forming a panel for a backing and/or a seating for a seating type piece of furniture and the frame, which connection is an integral part of the end portion of the straps and which end portion is inserted into and anchored in a slot of the frame.

A further object of the present invention is to provide an improved connection between the individual straps or the straps of a panel forming a backing and/or seating of a piece of furniture and a tubular frame, which connection consists of a tab at the end of the straps and which tab is a raised portion of the end of the strap.

A still further object of the present invention is to provide an improved connection for the individual straps or the straps of a panel forming a backing or a seating of a seating type piece of furniture and its frame, which connection is effective, easy to manufacture, and easy to insert into a slotted opening in the frame for easy assembling of the furniture.

These and other objects of the present invention will be more fully understood and appreciated from the following description of the invention on reference to the illustrations appended thereto.

BRIEF DESCRIPTION OF TEE DRAWINGS

Figure 1:
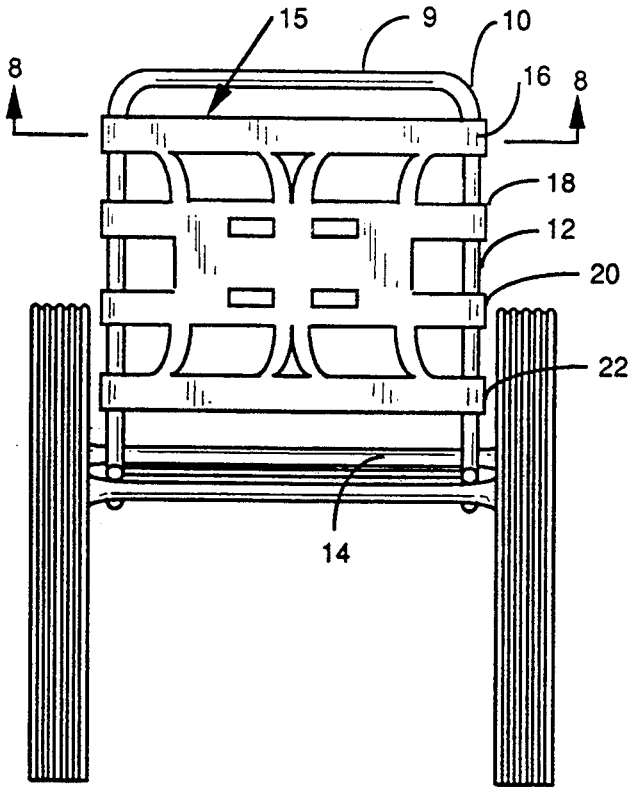
FIG. 1 is a front elevational view showing a first embodiment of the present invention which is a panel assembled to form a backing and a seating on a tubular frame of a chair.
Figure 3:
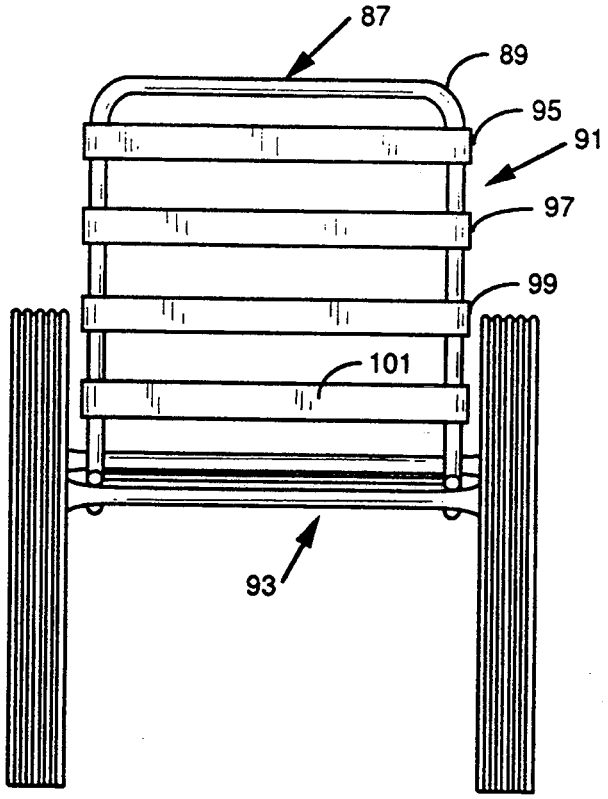
FIG. 3 is a front elevational view of a second embodiment of the present invention in assembled form for forming a backing and/or seating on a tubular frame of a chair, which consists of individual spaced-apart straps.
Figure 5:
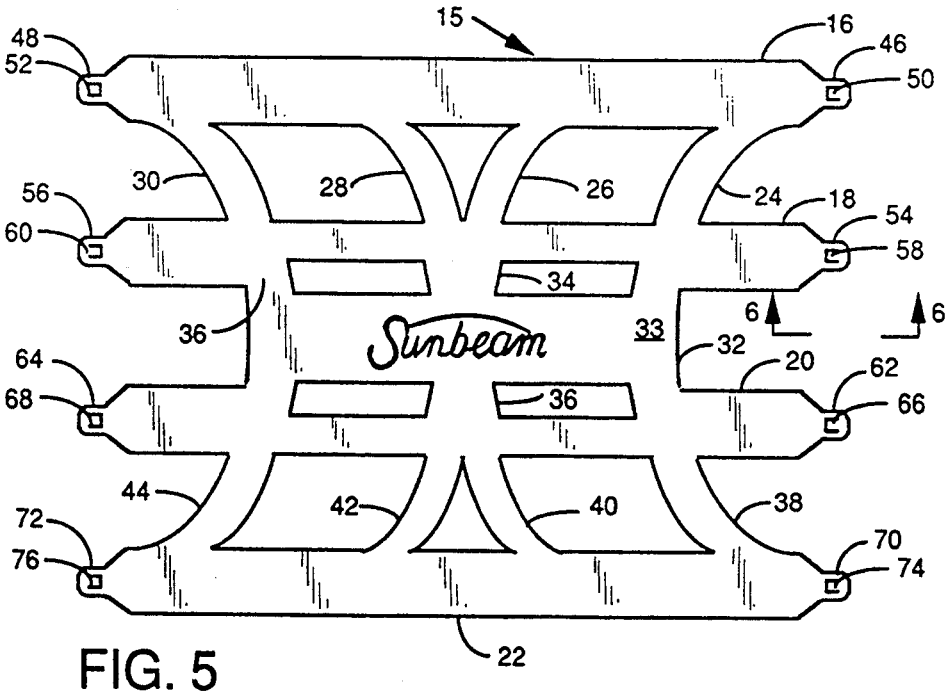
Figure 6:
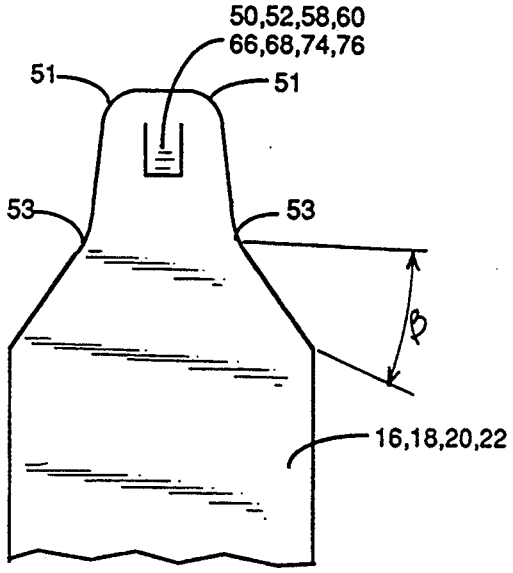
Figure 7:
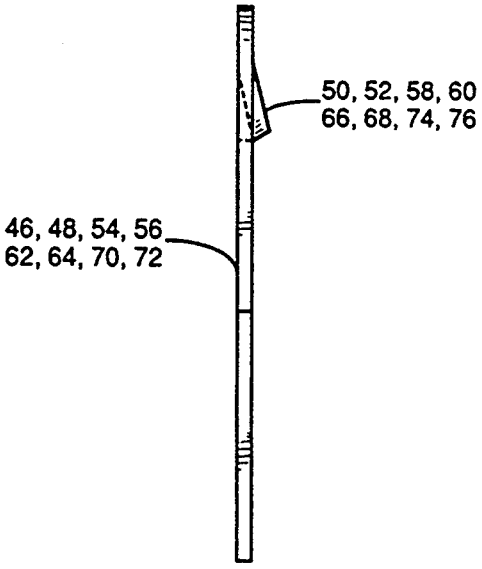
Figure 8:
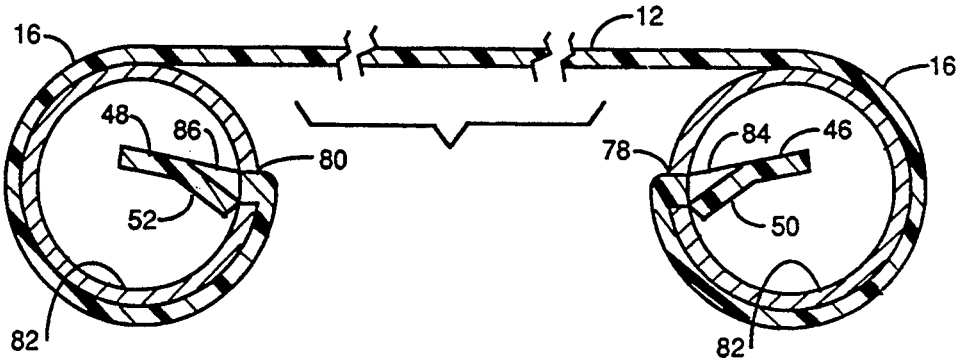
Figure 9:
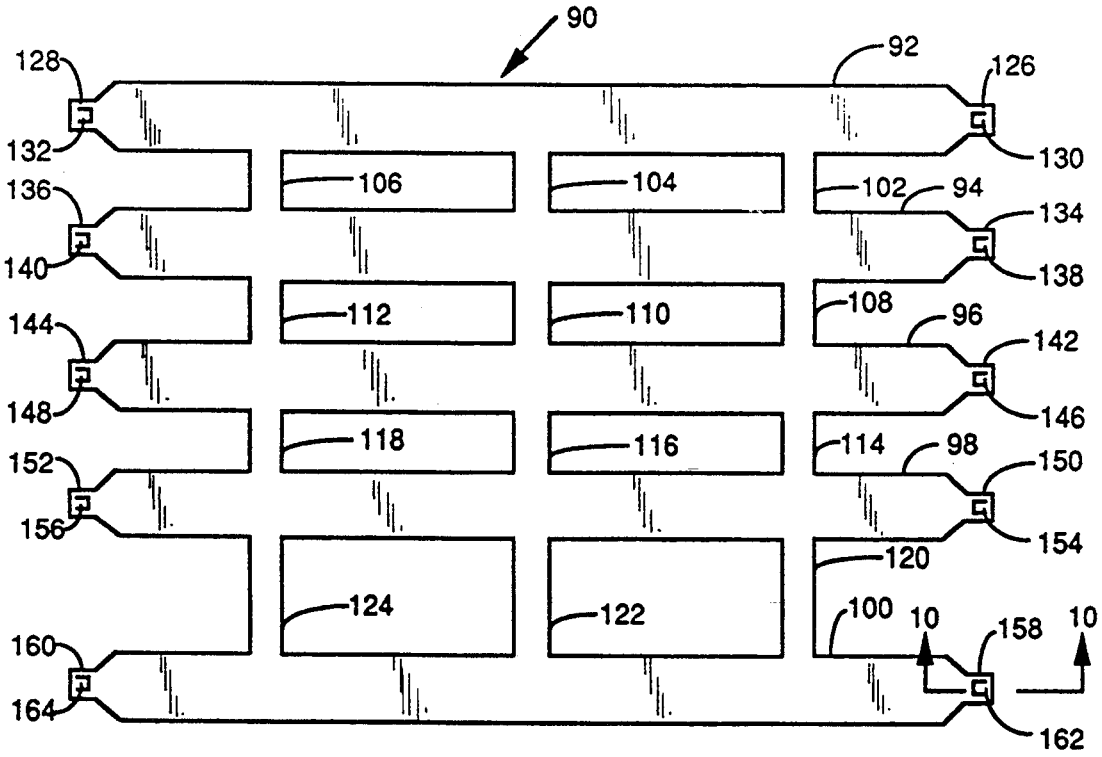
Figure 10:
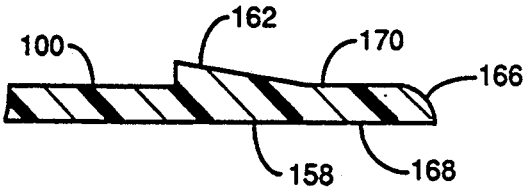
Figure 11:
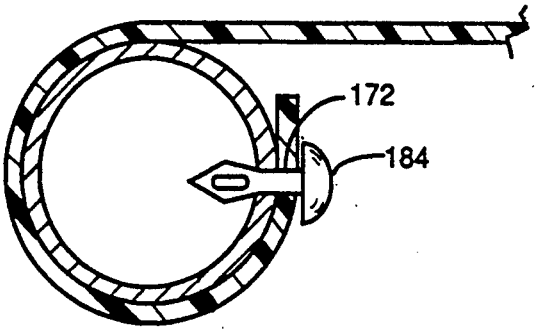
Figure 12:
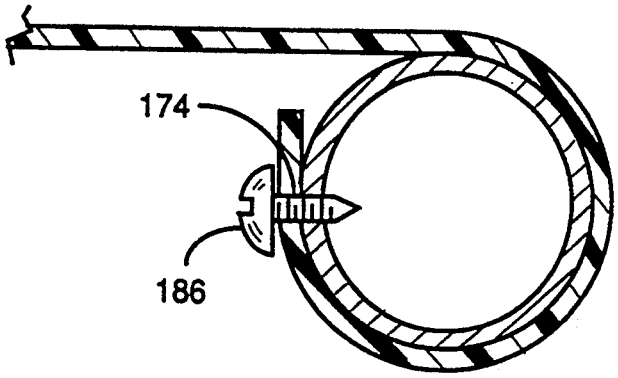
Figure 13:
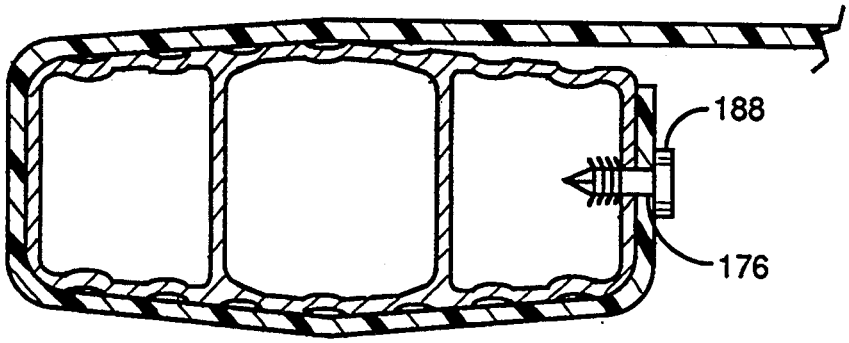

FIG. 5 a front elevational view showing the panel of the first embodiment of the present invention in unassembled form;

FIG. 6 is an enlarged view showing a portion of the tangs of the straps of the present invention and the self-locking tab;

FIG. 7 is a side elevational view of FIG. 6;

FIG. 8 is a cross-sectional, broken away view taken along lines 8—8 in FIG. 1;

FIG. 9 is a front elevational view showing a one-piece molded panel which is a second embodiment for the panel of the present invention;

FIG. 10 is an enlarged detail cross-sectional view of an end of the panel taken along lines 10—10 in FIG. 9, and illustrates a second embodiment of a self-locking tab of the present invention;

FIG. 11 is an enlarged cross-sectional view of a strap which can be an individual strap of FIG. 3 or a strap of panel of FIG. 1 illustrating a first embodiment of external fastening means for attaching the strap to a tubular frame member;

FIG. 12 is an enlarged cross-sectional view showing a second embodiment for external fastening means for attaching the strap of the invention of FIGS. 1 and 3 to a tubular frame member; and FIG. 13 is an enlarged, cross-sectional view showing a third embodiment for external fastening means for attaching the strap of FIGS. 1 and 3 to an extruded shaped frame member.

DETAILED DESCRIPTION OF TEE PREFERRED EMBODIMENTS

The present invention pertains to, but is not limited to, all seating type furniture, such as a chair, a rocker, a glider, a chaise lounge, or a sofa-type piece adapted to seat more than one person at a time. The furniture may be patio furniture for indoor or outdoor use.

Figure 2:
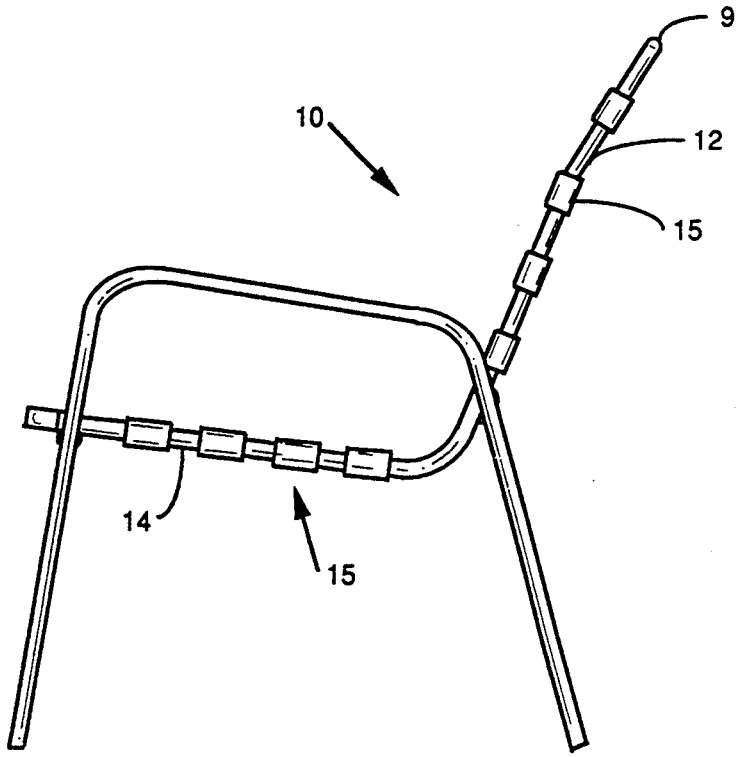
FIG. 2 is a side elevational view of FIG. 1.
Figure 4:
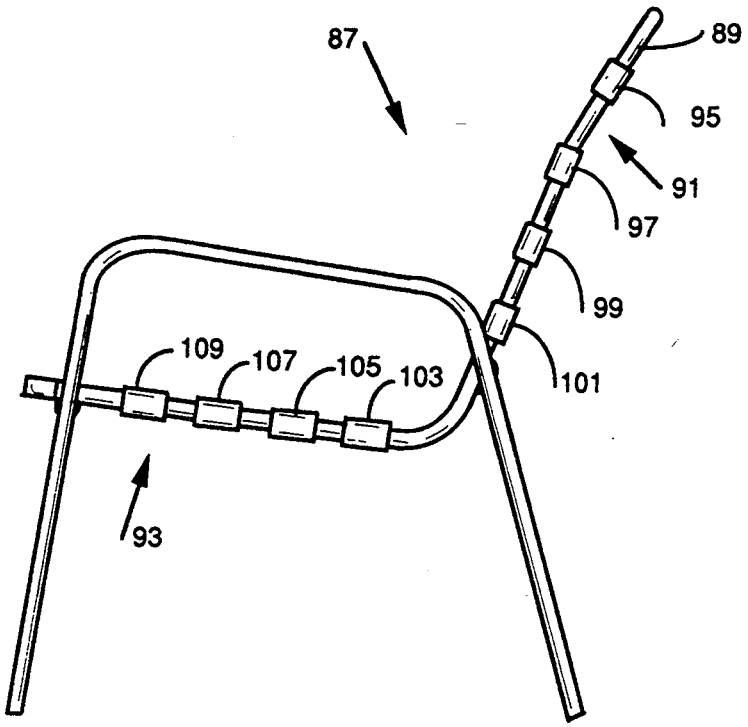
FIG. 4 is a side elevational view of FIG. 3.

FIGS. 1 and 2 show a first embodiment of the invention for forming a backing and/or seating, and FIGS. 3 and 4 show a second embodiment of the present invention for forming a seating and/or backing.

Referring first to FIGS. 1 and 2, there is shown a chair 10 made of a tubular frame shaped to form a back 12 and a seat 14. The tubular frame 9 is normally made from metal tubing. Frame 9 could be made using aluminum extrusion or it could be a plastic molded frame.

The frame 9 of chair 10 is rigidly assembled, but it is to be understood that the seat 14 and back 12 can secured to a frame construction which can be easily folded for storage.

The arms and legs of chair 10 are formed from a one-piece, aluminum extrusion as best shown in FIG. 2, but may be made by several tubing pieces welded together.

The backing for back 12 and the seating for seat 14 of FIGS. 1 and 2 are formed by a one-piece panel indicated in the FIGS. 1 and 2 by numeral 15. Preferably panel 15 is made of plastic, such as polyvinylchloride by a molding process. This one-piece construction for panel 15 is better shown in FIG. 5. In particularly referring to FIG. 5, panel 15 has several strap elements 16, 18, 20 and 22. Strap element 16 is integrally connected to strap element 18 by ribs 24, 26, 28, and 30. Strap element 18 is integrally connected to strap element 20 by a central member 32 and ribs 34 and 36. Strap element 20 is integrally connected to strap element 22 by ribs 38, 40, 42, and 44.

Panel 15 is made of a relative sturdy, flexible material with enough strength to support varying loads. Preferably, the material is plastic, and preferably polyvinylchloride (PVC). Central member 32 is wide enough to display a tradename or a trademark of the manufacturer and/or supplier of chair 10. As can be seen in this FIG. 5, the trademark "SUNBEAM" is displayed on central member 32. This logo or trademark may be advantageously molded into member 32 so as to be presented in relief form on the surface of central member 32.

Still referring to FIG. 5, straps 16–22 have ends which are attached by means which will be discussed hereinafter with respect to the tubular frame members of chair 10. Strap 16 has two opposed tangs 46 and 48, which tangs 46 and 48 have a tab 50 and 52, respectively. Strap 18 has two opposed tangs 54 and 56 with tabs 58 and 60, respectively. Strap 20 has two opposed tangs 62 and 64 with tabs 66 and 68, respectively. Strap 22 has two opposed tangs 70 and 72 with tabs 74 and 76, respectively.

FIGS. 6 and 7 best show the tabs in their respective tang. Tabs 50, 52, 58, 60, 66, 68, 74 and 76 are shear formed in their respective tang, 46–72 (even numbers only). In FIG. 5, tabs 50, 52, 58, 60, 66, 68, 74, and 76 are raised away from the top surface of panel 15 and the end of their respective tang in an inclined manner. It is to be appreciated, however that tabs 50–76 (even numbers only) can be formed in the bottom surface of panel 5. The die used for cutting tabs 50–76 has a three-sided cutting punch which shears the tabs only on three sides. As the die shears in a downward movement, it forms the tabs 50–76 down on the fourth side which does not get sheared.

FIG. 7 more clearly shows the inclination and direction for tabs 50, 52, 58, 60, 68, 74 and 76. That is, the tabs are raised at an angle of about 9° to about 17° from the end of their respective tang 46–72. The shearing process for forming tabs 50, 52, 58, 60, 68, 74, and 76 forms an opening in the respective tang adjacent to where the tab is formed, as indicated in dotted line in FIG. 7. Tabs 50, 52, 58, 60, 68, 74, and 76 are U-shaped.

FIG. 6 best shows the configuration of tabs 50, 52, 58, 60, 66, 68, 74 and 76 on tangs 46, 48, 54, 56, 62, 64, 70 and 72. As can be seen, the end of the tangs has a radius as indicated by numeral 51 on its both sides. This end radius is about 0.250 inches but can range from about 0.187 to about 0.312 inches. The inward end of the tang has a radius as indicated by numeral 53 on its both sides. This radius is about 0.500 inches, and can range from about 0.375 inches to about 0.500 inches. The inward width of tangs 46–72 is about 0.812 inches, and can range from about 0.568 inches to about 0.812 inches. The outward width of tangs 46–72 near the outer radii is about 0.688 inches and can range from about 0.437 inches to about 0.750 inches. The length of the tangs from the outward width to the inward width are about 0.812 inches, and can range from about 0.625 inches to about 0.812 inches.

Tabs 50–76 are located away from the edge of tangs 46–72 about 0.250 inches, and can range from about 0.185 inches to about 0.250 inches. The length of tabs 50–76 is about 0.250 inches and can range from about 0.187 inches to about 0.250 inches. The width of the tabs is about 0.203 inches, and can range from about 0.187 inches to about 0.250 inches.

As can be seen in still referring to FIG. 6, tangs 46–72 flare outwardly from the inward radius at numeral 53 toward the main body portion of straps 16, 18, 20, and 22. The angle $\beta$ is formed from radius 53 to the edge of the body of straps 16, 18, 20, and 22. The angle $\beta$ is about 48.20°, and can range from about 60° to about 40°. The dimensions of tangs 46–72 from the extreme edge of the tangs to the point where the angle $\beta$ ends on the main body portion of straps 16, 18, 20, and 22 is about 1.406 inches, and can range from about 1.312 inches to about 1.500 inches.

The width of the main body portion of straps 16, 18, 20, and 22 is about 1.875 inches, and can range from about 1.750 inches to about 2.000 inches.

Tabs 50, 52, 58, 60, 66, 68, 74 and 76 are self-locking devices which fasten the straps 16, 18, 20, and 22 of molded panel 15 to the tubular frame of chair 10 of FIGS. 1 and 2. The manner in which this is accomplished is shown in FIG. 8 for strap 16. The tubular frame member 9 is provided on its under or rear quadrant with a series of slot-like openings, disposed in axially spaced relationship therealong. Such slots are indicated by numerals 78 and 80 in FIG. 8 for receiving tang 46 and 48, respectively, of strap 16. Strap 16 is wrapped around frame member 9 and tangs 46 and 48 are inserted into openings 78 and 80.

In referring particularly to FIG. 8 and in the assembling of panel 15 to frame 9 of chair 10 of FIGS. 1 and 2, the one side of strap 16, in referring to the left of FIG. 8, is inserted first into slot 80 until tab 52 is totally within slot 80 of tubular frame 9. Strap 16 is then stretched and wrapped around frame member 9 and inserted into the tubular frame until tab 52 catches and abuts itself against inner wall 82 of the tubular frame 9 to anchor tang 48, thereby securing this side of strap 16 to the tubular frame 9 of chair 10. The other side of strap 16 which is illustrated to the right when referring to FIG. 8 is inserted in a similar manner. The remaining straps 18, 20, and 22 are inserted in similar slots or openings (not shown) in the tubular frame 9 in a similar manner to tautly secure panel 15 to frame 9 to form the back 12 and the seat 14 of FIGS. 1 and 2.

The lines indicated at numbers 84 and 86 in FIG. 8 represent the openings in tangs 46, 48 from which tabs 50, 52, respectively are formed. When tangs 46, 48 are inserted in their respective slots 78, 80 which have a width slightly less than the thickness of tangs 46, 48, their respective tabs 50, 52 are compressed slightly into their respective openings 84 and 86, and then spring out therefrom once tangs 46, 48 are inside frame 9. The manner in which tabs 50, 52, 58, 60, 66, 68, 74, and 76 self-lock against inner wall 82 of frame 9 prevents slippage and removal of straps 16, 18, 20, and 22 from the frame of chair 10.

The slots or openings 78 and 80 are generally rectangular and large enough to allow the respective tang to enter inside frame 9, but small enough so that the tang will not be released therefrom. For example, if the width and thickness of strap 16 are those dimensions discussed hereinbefore, then openings 78 and 80 are about 0.075 to about 0.085 inches wide and about 0.750 inches long.

Panel 15 is secured to frame 9, as discussed hereinbefore, for forming the seating for seat 14 and the backing for back 12 of chair 10 of FIGS. 1 and 2.

FIGS. 3 and 4 illustrate another embodiment of the present invention. Chair 87 is made of a tubular frame 89 which is shaped to form back 91 and a seat 93. Frame 89 may preferably be made out of the same materials as that of frame 9 of chair 10 of FIGS. 1 and 2.

The backing for back 91 is formed by a plurality of individual straps indicated by numerals 95, 97, 99, and 101, and the seating for seat 93 is formed by a plurality of individual straps 103, 105, 107, and 109, shown only in FIG. 4.

Preferably, straps 95, 97, 99, 101, 103, 105, 107, and 109 are spaced apart and are made from a plastic, such as polyvinylchloride (PVC) through an injection molding process. Preferably, the opposite ends of these straps 95–109 (odd numbers only) have a tang portion with a tab, similar to that of FIGS. 1, 2, 5, 6, 7, and 8 which are inserted into openings or slots in frame 89, which slots are similar to those in frame 9 of chair 10 of FIGS. 1 and 2. Straps 95–109 can also be produced from extruded lengths of plastic material in roll form, where the rolled material is fed through a cutting die which forms the shape of the tangs and shear forms the tab. As the tangs are cut, the length of each strap is determined.

FIG. 9 illustrates a second embodiment for a molded panel for forming a backing and a seating for chair 10 of FIGS. 1 and 2. This one piece panel 90 is made of a sturdy and flexible plastic material, preferably polyvinylchloride, and has several straps 92, 94, 96, 98, and 100. The number of straps may vary depending on whether panel 90 is used for a backing or a seating. Preferably, for a seat panel, panel 90 may have the number of straps shown in FIG. 9, and for a back panel it may have fewer straps.

Still referring to FIG. 9, strap 92 is spaced away from strap 94 by ribs 102, 104, and 106. Strap 94 is spaced away from strap 96 by ribs 108, 110, and 112. Strap 98 is spaced away from strap 96 by ribs 114, 116, and 118. Strap 100 is spaced away from strap 98 by ribs 120,122, and 124.

Strap 92 has opposed tangs 126 and 128 which have tabs 130, 132, respectively. Strap 94 has opposed tangs 134 and 136 which have tabs 138 and 140, respectively. Strap 96 has opposed tangs 142 and 144 which have tabs 146 and 148, respectively. Strap 98 has opposed tangs 150 and 152, which have tabs 152 and 154, respectively. Strap 100 has opposed tangs 158 and 160, which have tabs 162 and 164, respectively. The several tabs 138, 140, 146, 148, 152, 154, 162, and 164 are shaped and formed differently from those of FIGS. 6, 7, and 8.

FIG. 10 best illustrates tabs 138–164 (even numbers only) for panel 90, and more particularly illustrates tang 158 and tab 162 of strap 100 of FIG. 9. Tab 162 is formed during the molding process for forming panel 90. The end 166 of tang 158 of FIG. 10 has a full radius from the bottom surface 168 to the top surface 170 of tang 158 for easy insertion of tang 158 into a slot in tubular frame member 9. As shown in cross-section in FIG. 10, tab 162 is a continuous solid portion of tang 158 and its inclination starts from the top surface 170 at end 166 upwardly and inwardly relative to end 166. Preferably, the thickness of tab 162 from its highest inclination point to its lowest is about 0.040 inches, but may range from about 0.025 inches to about 0.045 inches. The other dimensions of tab 162 and tang 158 are essentially similar to that described for FIGS. 6 and 7, but may vary slightly.

The configuration and dimensions of tangs 126, 128, 134, 136, 142, 144, 150, 152,158, and 160, and their respective tabs are similar to that described with respect to tang 158 and tab 162 of FIG. 10. The manner in which the tangs and tabs of straps 92–100 of FIG. 9 are inserted into the slots or openings of tubular frame member 9 of FIG. 1 for mounting panel 90 to form a seat and a back for chair 10 of FIG. 1 is similar to that described with regard to the panel 15 of FIGS. 1, 2, 5, 6, 7, and 8.

The tabs shown in FIGS. 9 and 10 can also be formed on the individual straps 89, 95, 97, 99, 101, 103, 105, 107, and 109 of FIGS. 3 and 4.

Panel 15 of FIG. 5, panel 90 of FIGS. 9 and 10, and the straps of FIGS. 3 and 4 can be mounted to tubular frame 9 or 89 with means other than the tabs shown in these Figures.

FIGS. 11, 12, and 13 illustrate several external means for attaching panels 15 and 90, and the straps of FIG. 3 to tubular frame 9 of FIG. 1 and frame 89 of FIG. 3. Instead of the tabs for each of the tangs, an opening is punched or formed in the molding process entirely through the thickness of each tang. Such an opening is indicated by numbers 172, 174, and 176, respectively, in FIGS. 11, 12, and 13. Corresponding openings (not shown or numbered) are formed in tubular frames 9 and 89. The ends of the straps of FIG. 3 and those of panels 15 and 90 are wrapped around tubular frames 9 and 89. Fastening means 184, 186, and 188, respectively in FIGS. 11, 12, and 13, are inserted in the openings of the straps or panels and of tubular frame 9 or 89. Fastener means 184 is a canoe clip. Fastener means 186 is a screw, and fastener means 188 is a Christmas tree clip. These several fastener means are known to those skilled in the art. The openings in the straps, panels, and frames preferably are circular holes which are sized to accommodate the respective fastener means 184, 186, and 188.

Generally, it is to be understood that the tangs of the panels 15 and 90, and the individual straps of the invention are pushed into the slots in the frame 9 or 89. The tabs compress to allow this insertion to occur. Since the strap or straps are wrapped around the tubular seat and/or back frame member, the tab interacts with the inside edge of the slot in frame member 9 or 89 to create the locking effect. The wrapping of the strap or straps around the seat or back frame and the locking effect of the tab in the slot in frame 9 or 89, creates the holding strength of the seating and/or backing for chairs 10 and 87 of FIGS. 1 and 3, respectively.

Whereas particular embodiments of the invention have been described above for purposes of illustration, it will be appreciated by those skilled in the art that numerous variations of the details may be made without departing from the invention as described in the appended claims.

Even though panel 15 of FIG. 3 and panel 90 of FIG. 6 are shown, other designs can be provided without diverting from the spirit and scope of the invention. More particularly, the design could be an imitation basket weave wherein ridges are molded into the panel to simulate overlapping straps.

In accordance with the provisions of the patent statutes, I have explained the principles and operation of my invention and have illustrated and described what I consider to represent the best embodiment thereof.

I claim:

1. An article of seating-type furniture, comprising:

a frame forming a back and/or a seat for said furniture, and having slot means, and at least one strap means forming a backing and/or seating panel for said furniture, said at least one strap means having a main body and opposite ends adjacent to said main body, said strap means opposite ends each having a tang portion with a top surface and a bottom surface, each of said tang portions having integrally molded tab means on one of said tang portion surfaces for insertion into and engagement in said slot means of said frame, said tab means having an inclined surface and a rear wall wherein said inclined surface extends from said one of said surfaces of said tang portion having said tab means and is at an angle relative to the other of said tang portion surfaces directly opposite said tab means, said inclined surface terminating inwardly of said strap means opposite ends at said rear wall, said rear wall extending substantially perpendicular from said one of said tang portion surfaces, said tab means being solid and continuous with said strap means.

2. An article of claim 1, wherein said at least one strap means consists of a one piece molded panel means having a plurality of straps which are interconnected by connecting members and which form said backing and/or said seating for said furniture.

3. An article of claim 1, wherein said at least one strap means consists of a plurality of individually spaced-apart straps which form said backing and/or said seating for said furniture.

4. An article of claim 1, wherein said tang portion has rounded edges for easy insertion into said slot means.

5. An article of claim 1, wherein said at least one strap means and said tab means are made of a material which is flexible and yet strong enough so that said tab means remains in said slot means and said at least one strap means withstands various loads.

6. An article of claim 1, wherein said at least one strap means is made of a plastic material.

7. An article of claim 1, wherein said tab means is made of a resilient material which allows said tab means to be pushed inwardly upon its insertion into said slot means, and allows said tab means to spring back for said engagement thereof in said slot means of said frame.

8. The article of seating type furniture of claim 1, wherein each of said opposite ends has a radiused end to facilitate the insertion of each of said opposite ends into said slot means of said frame.

9. An article of seating type furniture of claim 1, wherein:

said slot means of said frame is located so that said at least one strap means is wrapped around said frame approximately 270 degrees.

10. An article of seating type furniture, comprising:

a frame having tubular means which form a back and a seat for said furniture, a first panel means forming a seating for said seat, a second panel means forming a backing for said back, each of said first and second panel means being a one piece, injection molded panel with a plurality of strap elements, and fastening means for securing each of said strap elements of said first and second panel means to said frame.

11. The article of seating type furniture of claim 10, wherein said strap elements have opposite ends and further comprising:

a tang on each of said opposite ends of said each strap element and having an opening, and wherein said fastening means consists of an external fastener which extends through said opening of said tang and into said frame.

12. The article of seating type furniture of claim 10, wherein said fastening means have an inclined surface beginning from a surface of said strap means proximate said end of said strap means, said inclined surface terminating inwardly of said strap means end, said tab means inclined surface terminating at a rear wall, said rear wall being substantially perpendicular to said strap means surface, said fastening means being solid and continuous with said strap means.

13. The article of seating type furniture of claim 12, wherein each of said strap means is a one piece molded panel.

14. The article of seating type furniture of claim 12, wherein each of said strap means is a plurality of individually spaced-apart straps.

15. The article of seating type furniture of claim 12, wherein said fastening means are integrally molded tabs which are solid and continuous with the end of said strap means.

16. A method of forming a seating type of furniture, the steps comprising:

providing a frame having tubular means for forming a back for said furniture, forming a backing for said back of said furniture with an injection molded one-piece panel means, and employing fastening means for securing said panel means to said back of said furniture.

17. A method claim 16, the steps further comprising:

forming said panel means to consist of a plurality of straps which are interconnected by rib means.

18. A method of claim 16, the steps further comprising:

making said one-piece panel means from a material which is flexible and having enough strength to withstand various loads.

19. A method of claim 16, the steps further comprising:

making said one-piece panel means from plastic.

20. A method of claim 16, the steps further comprising:

employing integrally molded self-locking fastening means on said panel means, and inserting said fastening means into slot openings in said frame.

21. A method of forming a seating type of furniture, the steps comprising:

providing a frame having tubular means for forming a seat for said furniture, forming a seating for said seat of said furniture with an injection molded one-piece panel means, and employing fastening means for securing said one-piece panel means to said seat of said furniture.

22. A method of claim 21, the steps further comprising:

forming said panel means to consist of a plurality of straps interconnected by rib means.

23. A method of claim 21, the steps further comprising:

making said one-piece panel means from a material which is flexible and having enough strength to withstand various loads.

24. A method of claim 21, the steps further comprising:

making said one-piece panel means from plastic.

25. A method of claim 21, the steps further comprising:

employing integrally formed self-locking fastening means on said panel means, and inserting said fastening means into slot openings in said frame.

* * * * *